US009681517B2

(12) United States Patent
Hamilton et al.

(10) Patent No.: US 9,681,517 B2
(45) Date of Patent: Jun. 13, 2017

(54) DIM-TO-WARM SYSTEM AND METHOD OF OPERATING THE SAME

(71) Applicant: Hubbell Incorporated, Shelton, CT (US)

(72) Inventors: Douglas M. Hamilton, Arlington Heights, IL (US); Anthony M. Mackey, Downers Grove, IL (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 15/098,851

(22) Filed: Apr. 14, 2016

(65) Prior Publication Data

US 2016/0309561 A1 Oct. 20, 2016

Related U.S. Application Data

(60) Provisional application No. 62/147,914, filed on Apr. 15, 2015.

(51) Int. Cl.
*H05B 37/00* (2006.01)
*H05B 33/08* (2006.01)

(52) U.S. Cl.
CPC ..... *H05B 33/0872* (2013.01); *H05B 33/086* (2013.01); *H05B 33/0845* (2013.01); *H05B 33/0863* (2013.01); *H05B 33/0866* (2013.01)

(58) Field of Classification Search
CPC ..... H05B 33/08; H05B 33/02; H05B 37/029; H05B 33/0803; H05B 37/0254; H05B 37/02; H05B 33/0818
USPC ..... 315/291, 293, 294, 295, 312, 246
See application file for complete search history.

(56) References Cited

U.S. PATENT DOCUMENTS

2011/0127921 A1* 6/2011 Lin ..... H05B 33/0827 315/192
2012/0299500 A1* 11/2012 Sadwick ..... H05B 33/0887 315/224
2013/0063035 A1* 3/2013 Baddela ..... H05B 33/0845 315/192
2013/0229119 A1 9/2013 Korobov et al.
2014/0191674 A1 7/2014 Baddela et al.
2014/0239828 A1 8/2014 Smith

OTHER PUBLICATIONS

PCT/US2016/027485 International Search Report and Written Opinion dated Jul. 26, 2016.

* cited by examiner

*Primary Examiner* — Minh D A
(74) *Attorney, Agent, or Firm* — Michael Best & Friedrich, LLP

(57) ABSTRACT

A method of controlling a correlated color temperature for light output by a lighting device including a dim-to-warm circuit having a first light channel and a second light channel. The method including receiving a current input; measuring current of the current input to obtain a measured current value; and determining a light control value based on the measured current value. The method further including using the light control value, determining a first current value for applying a first current to the first light channel and determining a second current value for applying a second current to the second light channel; and providing the first current to the first light channel and providing the second current to the second light channel to obtain different desired correlated color temperatures for the light output at different ones of the light control values.

18 Claims, 5 Drawing Sheets

DIM-TO-WARM SYSTEM AND METHOD OF OPERATING THE SAME

RELATED APPLICATIONS

The present application claims priority to U.S. Provisional Application No. 62/147,914, filed Apr. 15, 2015, the entire contents of which are hereby incorporated.

BACKGROUND

The present application relates generally to light-emitting diodes (LEDs).

SUMMARY

LEDs are typically used as indicator lights or signs. Recently, LEDs have been deployed in other lighting applications, such as but not limited general lighting or illumination. The relatively-low power consumption for LEDs as compared to incandescent lights in combination with LEDs' color quality and warm correlated color temperature (CCT) at high color rendering index (CRI) levels, make LEDs a popular choice both for new construction and for replacement/retrofit of older less efficient systems. CCT is a measure of light source color appearance defined by the proximity of the light source's chromaticity coordinates to the blackbody locus. CRI describes how the light source makes the color of an object appear to a human eye and how well subtle variations in color shades are revealed. The CRI of a given light source is provided as a scale from 0 to 100 percent, which indicates how accurate the light source is at rendering color when compared to a "reference" light source, such as a halogen light source which has a CRI of 100.

Replacing or retrofitting older light sources, such as those using incandescent, fluorescent, and/or halogen lamps, with more efficient LED-based sources, however, is not always as easy as simply replacing the bulb. For example, because LEDs are solid-state lighting (SSL) devices they have different electrical requirements than more traditional light sources or lamps. Thus, LED lighting systems often require additional design considerations and circuitry to render them a favorable replacement for older lamps. One area where different circuitry is needed is in the driver, which receives the input power, such as mains power (e.g., approximately 120 volts alternating current (VAC) at approximately 60 Hz, or approximately 220 VAC at approximately 60 Hz, in the U.S.), and delivers a proper voltage and current to the LEDs being used. Because many lighting applications also require the ability to dim the lights, dimmer circuits is another area where different circuitry is needed to render LEDs a good replacement or retrofit for older lamps.

Properly designed driver circuits can dim SSL products smoothly and linearly while also delivering linear energy savings. Problems arise, however, when legacy phase-cut or triac dimmers are used to dim LEDs. Such legacy dimmers were not intended to work with a switching power supplies, such as those typically found in an LED driver.

Another related issue results from the manner by which an LED itself dims. As the light level decreases, LEDs generally maintain the same color temperature (CCT) that they exhibit at full power. Incandescent and halogen lamps, on the other hand, dim to a warm CCT at lower levels, an often desirable effect, for example, in the hospitality industry.

Several drivers for luminaires, both with and without integral LED lamps, that are functionally capable of dimming are known. Dimming to a warm color temperature, i.e., "dim-to-warm," however, is rapidly becoming a feature desired by many lighting customers. The dim-to-warm functionality is generally achieved by adding red or amber LEDs into a fixture or lamp and mixing the amber/red light with white light to achieve a warmer color temperature. Typically, adding different color LEDs requires one or more additional driver channels to control the separate LED strings. As the overall drive current is reduced, e.g., by operation of a standard phase-cut dimmer, the percentage of energy supplied to the amber/red channel is raised relative to the power supplied to the white channel.

The result of dim-to-warm technology is lighting products that deliver 2700K-3000K CCT light at full power yet smoothly reduce the CCT to the 1800K range at the lowest light levels. However, such existing dim-to-warm technology is relatively expensive because of the dual-channel driver and additional LEDs. Efficient compact fluorescent lamps (CFLs) or ceramic metal-halide sources have never been capable of such a functionality.

The present application solves these issues, by in one embodiment, providing a method of controlling a correlated color temperature for light output by a lighting device including a dim-to-warm circuit having a first light channel and a second light channel. The method including receiving a current input; measuring current of the current input to obtain a measured current value; and determining a light control value based on the measured current value. The method further including using the light control value, determining a first current value for applying a first current to the first light channel and determining a second current value for applying a second current to the second light channel; and providing the first current to the first light channel and providing the second current to the second light channel to obtain different desired correlated color temperatures for the light output at different ones of the light control values In another embodiment the invention provides a dim-to-warm lighting system including a current drive, a current measuring device, a first light channel, a first current control, a second light channel, a second current control, and a controller. The current drive provides a current output. The current measuring device receives and measures the current output from the current drive, and further outputs a measured current value of the current output. The first light channel has a first correlated color temperature and is in electrical communication with the current drive. The first current control controls a first current through the first light channel based on a first current value. The second light channel has a second correlated color temperature different than the first correlated color temperature and is in electrical communication with the current drive. The second current control controls a second current through the second light channel based on a second current value. The controller receives the measured current value from the current measuring device. The controller is configured to determine a light control value from the measured current value, using the light control value, determine a first current value for the first current control, using the light control value, determine a second current value for the second current control, communicate the first current value to the first current control, communicate the second current value to the second current control, and provide the light output having a correlated color temperature by providing the first current value to the first current control and the second current value to the second current control.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

The phrase "series-type configuration" as used herein refers to a circuit arrangement where the described elements are arranged, in general, in a sequential fashion such that the output of one element is coupled to the input of another, but the same current may not pass through each element. For example, in a "series-type configuration," it is possible for additional circuit elements to be connected in parallel with one or more of the elements in the "series-type configuration." Furthermore, additional circuit elements can be connected at nodes in the series-type configuration such that branches in the circuit are present. Therefore, elements in a series-type configuration do not necessarily form a true "series circuit."

Figure 1:
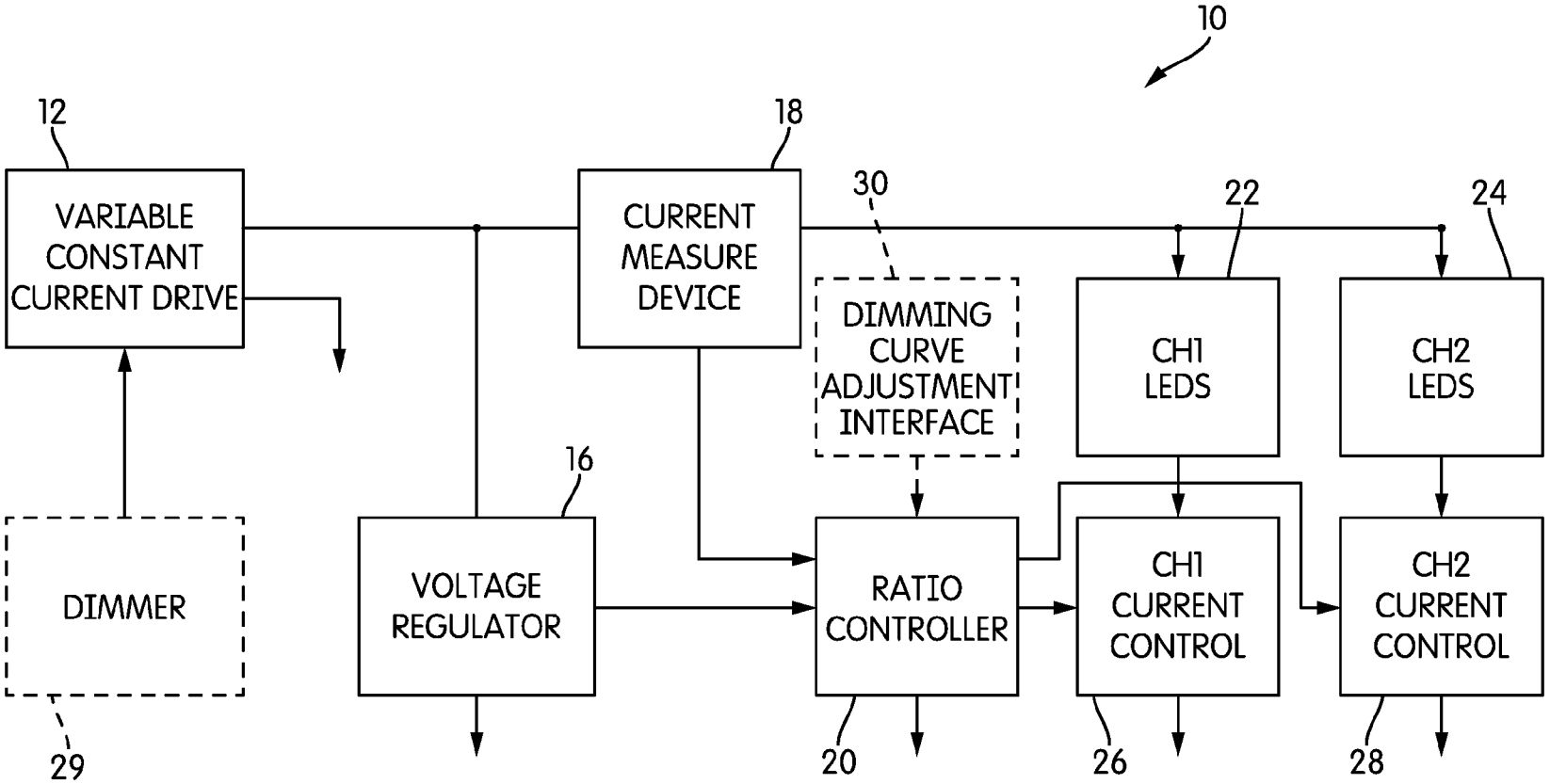
FIG. 1 is a block diagram of a dim-to-warm system according to some embodiments of the application.

FIG. 1 illustrates a block diagram of a dim-to-warm system 10. The dim-to-warm system 10 may include a variable constant current drive, or driver, 12, a voltage regulator 16, a current measure device 18, a ratio controller 20, a first light channel 22, a second light channel 24, a first current control 26, and a second current control 28.

The variable constant current drive 12 receives a mains voltage (e.g., approximately 120 VAC at approximately 60 Hz, approximately 240 VAC at approximately 60 Hz, etc.) and outputs a direct current (DC). In some embodiments, the dim-to-warm system 10 further includes a dimmer, or dimming adjustment device, 29. The dimmer 29 is a user-controlled device configured to adjust the magnitude of the DC current output from the constant current drive 12. In some embodiments, the DC current may be adjusted from approximately 10% to approximately 100% of the maximum current output. In other embodiments, rather than a dimmer 29, the dim-to-warm system 10 may include an on/off switch configured to selectively connect/disconnect the mains voltage from the variable constant current drive 12.

The voltage regulator 16 receives the DC current output from the variable constant current drive 12 and outputs a regulated voltage (e.g., 5 VDC) to provide power to the ratio controller 20. The current measure device 18 receives and measures the DC current output from the variable constant current drive 12. The current measure device 18 further outputs a measured current value signal to the ratio controller 20 and passes through the DC current output to the first light channel 22 and the second light channel 24.

The ratio controller 20 may be a controller including, for example, an electronic processor (e.g., a microprocessor, a microcontroller, or another suitable programmable device) and a memory. In some embodiments, the ratio controller 20 is implemented partially or entirely on a semiconductor (e.g., a field-programmable gate array ["FPGA"] semiconductor) chip, such as a chip developed through a register transfer level ("RTL") design process. The electronic processor may be connected to the memory, and executes software instructions stored on the memory. The software includes, for example, firmware, one or more applications, program data, filters, rules, one or more program modules, and other executable instructions. The ratio controller 20 is configured to retrieve from the memory and execute, among other things, instructions related to the control processes and methods described herein. For example, and as discussed in more detail below, the ratio controller 20 is configured to process the measured current value signal received from the current measure device 18 and output a first control signal and a second control signal, based on the measured current value signal, to the first current control 26 and the second current control 28, respectively.

As discussed above, the first light channel 22 and the second light channel 24 receive the DC current (through the current measure device 18) from the variable constant current drive 12. In some embodiments, the first light channel 22 and the second light channel 24 include one or more LEDs or a plurality of LEDs. In such an embodiment, the LEDs may be electrically connected in series. In some embodiments, the first light channel 22 includes one or more white LEDs having a first correlated color temperature (CCT) while the second light channel 24 includes one or more amber LEDs. In other embodiments, the second channel 24 may include one or more LEDs having other colors, for example but not limited to, red, green, variations of white, or any color different than white.

The DC current passes through the first light channel 22 and the second light channel 24 to the first current control 26 and the second current control 28, respectively. In some embodiments, the first current control 26 and the second current control 28 are transistors (e.g., a semiconductor device, such as but not limited to, a bipolar junction transistor (BJT), a field-effect transistor (FET), a metal-oxide-semiconductor field-effect transistor (MOSFET), a junction gate field-effect transistor (JFET), and an insulated-gate bipolar transistor (IGBT)). In such an embodiment, the ratio controller 20 provides the first control signal and the second control signal to a first gate of the first current control 26 and a second gate of the second current control 28, respectively, in order to control the flow of DC current through the first light channel 22 and the second light channel 24.

In some embodiments, such as the one illustrated, the dim-to-warm system 10 further includes a dimming curve adjustment interface 30. The dimming curve adjustment interface 30 communicates with the ratio controller 20 to adjust a dimming curve for the combination of light channels that are stored in the ratio controller 20. In one embodiment, the dimming curve adjustment interface 30 is a wireless device configured to provide wireless communication to the ratio controller 20. In such an embodiment, the dimming curve adjustment interface 30 may be a BlueTooth module, a WiFi module, or any known wireless communication module. In other embodiments, the dimming curve adjustment interface 30 is a resistor (e.g., a variable resistor).

Figure 2:
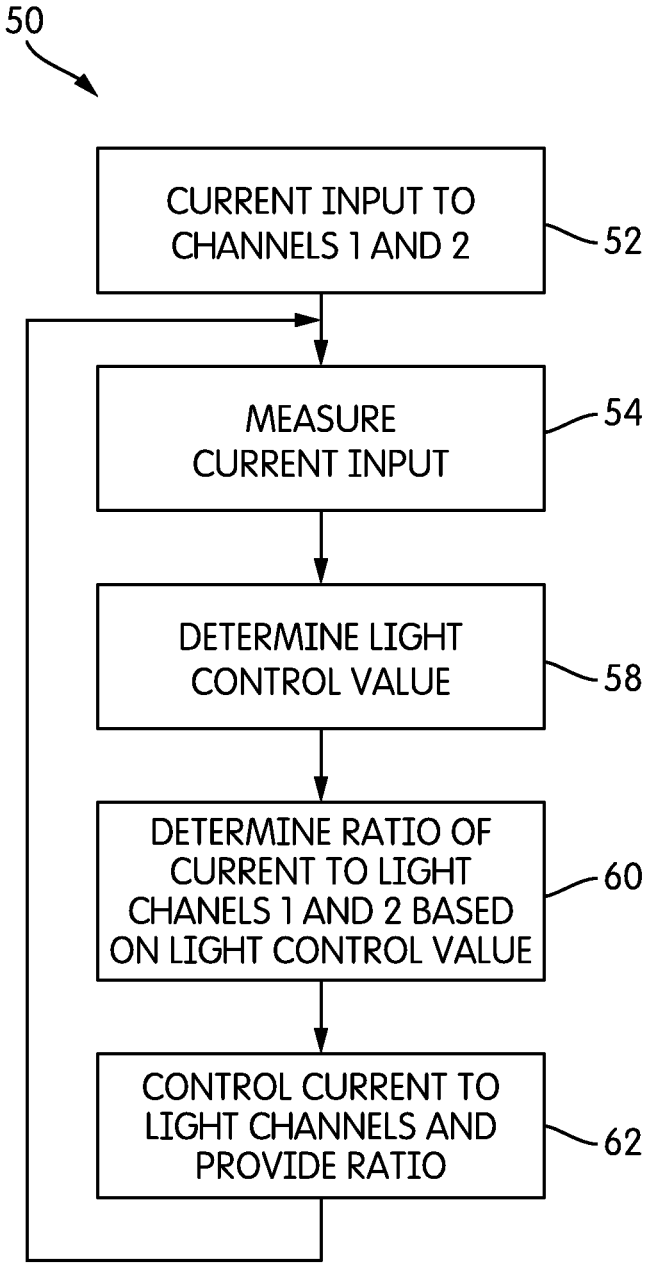
FIG. 2 is a flow chart illustrating an operation, or process, of the dim-to-warm system of FIG. 1 according to some embodiments of the application

FIG. 2 is a flow chart illustrating an operation, or process, 50 of the dim-to-warm system 10 according to some embodiments of the application. It should be understood that the order of the steps disclosed in process 50 could vary. Furthermore, additional steps may be added to the sequence and not all of the steps may be required. The variable constant current drive 12 outputs the DC current (through the current measure device 18) to the first light channel 22 and the second light channel 24 (step 52). As discussed above, in some embodiments the DC current output by the variable constant current drive 12 is set by the dimmer 29. The ratio controller 20 receives the measured current value signal from the current measure device 18 (step 54).

The ratio controller 20 compares the measured current value signal to a maximum current value to calculate, or otherwise determine, a light control value (step 58). In some embodiments, the light control value is approximately 0% to approximately 100%. In other embodiments, the light control value is approximately 10% to approximately 100%. In yet another embodiment, the light control value is approximately 5% to approximately 100%.

The ratio controller 20 determines a ratio of current provided to the first light channel 22 versus current provided to the second light channel 24 (step 60). Specifically, in some embodiments, the ratio controller 20 determines how much of the current output by the variable constant current drive 12 is provided to each of the light channels 22, 24. In some embodiments, the memory of the ratio controller 20 stores proportional current values for each of the light channels 22, 24 that correspond to a given percentage light control value.

Figure 3:
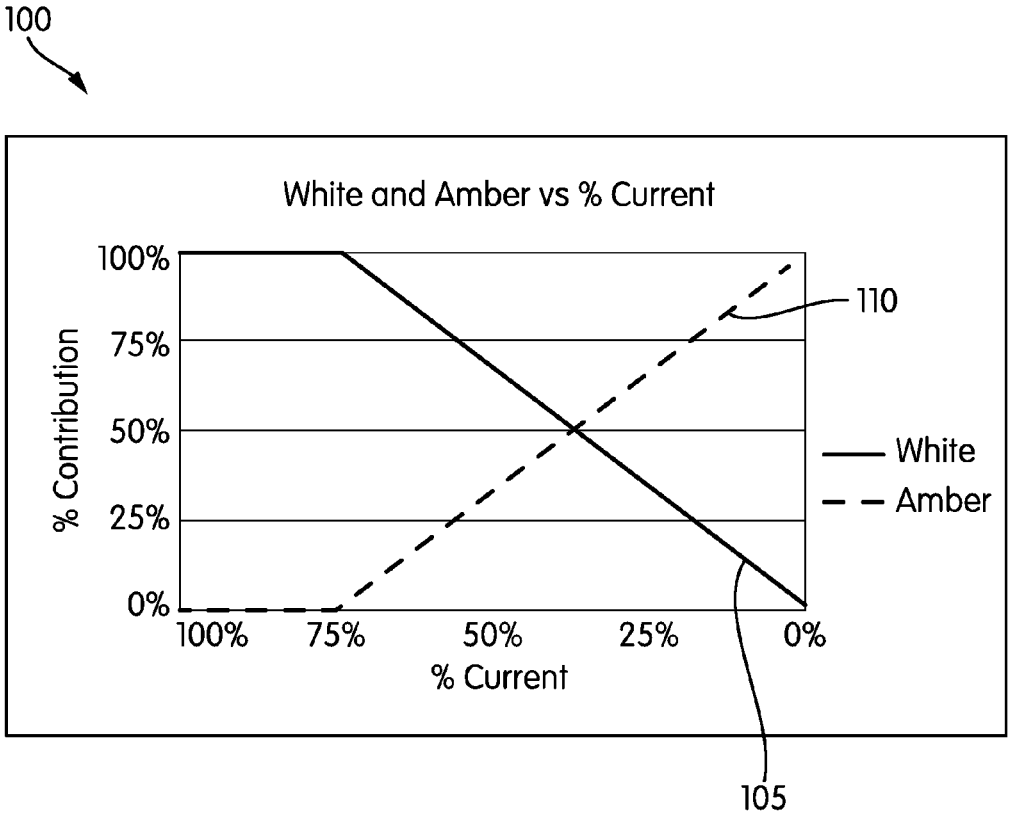
FIG. 3 illustrates a dimming curve graph of the dim-to-warm system of FIG. 1 according to some embodiments of the application

FIG. 3 illustrates a dimming curve graph 100 according to some embodiments of the application. In some embodiments, dimming curve graph 100, and/or values corresponding to the dimming curve graph 100, are stored in the memory of the ratio controller 20. The dimming curve graph 100 illustrates a first output 105 versus a second output 110. In some embodiments, the first output 105 corresponds to the output of the first light channel 22, while the second output 110 corresponds to the output of the second light channel 24. Additionally, in some embodiments, the first output 105 may correspond to a white light output, while the second output 110 may correspond to an amber light output.

In the illustrated embodiment of FIG. 3, when the percentage light control value is approximately 75% or greater, the DC current output by the variable constant current drive 12 is provided entirely to the first light channel 22. Additionally, in the illustrated embodiment of FIG. 3, when the percentage light control value is approximately 37%, the DC current output by the variable constant current drive 12 is provided to the first light channel 22 and the second light channel 24 equally. Thus, in the illustrated embodiment of FIG. 3, as the amount of DC current output by the variable constant current drive 12 decreases, the light output by second light channel 24 increases as the light output by the first light channel 22 decreases. In other embodiments, the light output by the respective first light channel 22 and the second light channel 24 may differ for a given percentage light control value. In some embodiments, the dimming curve adjustment interface 30 may be used to change the properties of the dimming curve used by the ratio controller 20.

Referring back to FIG. 2, in some embodiments, in step 60, the ratio controller 20 uses the dimming curve graph 100 to determine the ratio of current. The ratio controller 20 next outputs the first current control signal and the second current control signal, based on the determined ratio of current, to the first current control 26 and the second current control 28, respectively (step 62). In some embodiments, changing the first current control signal and the second current control signal results in different desired correlated color temperatures (CCTs) for the light output. The process 50 then cycles back to step 52.

Figure 4:
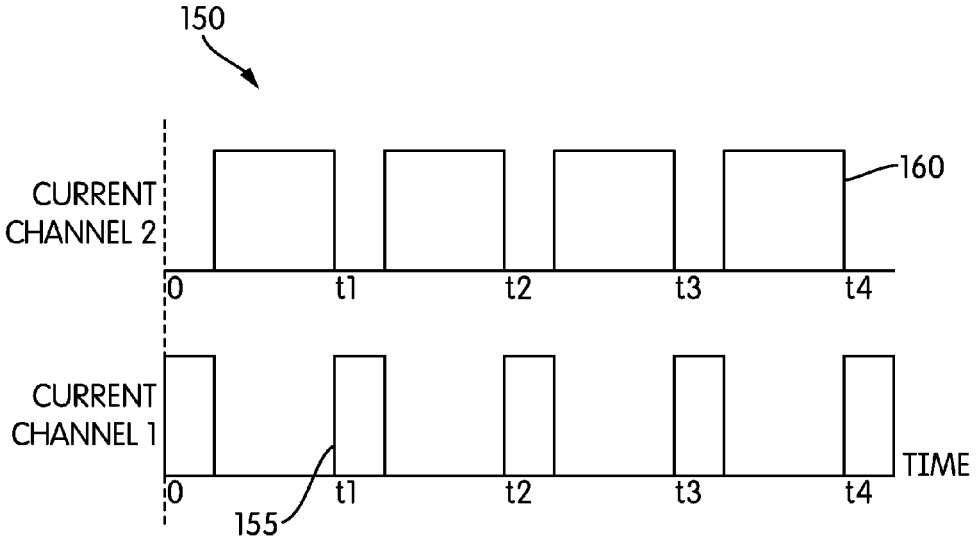
FIG. 4 is a graph illustrating a first current control signal and a second current control signal used in conjunction with the dim-to-warm system of FIG. 1, according to one embodiment of the application.

FIG. 4 is a graph 150 illustrating a first current control signal 155 being supplied to the first current control 26 and a second current control signal 160 being supplied to the second current control 28, according to one embodiment of the application. In some embodiments, the first current control signal 155 and the second current control signal 160 are pulse-width modulated (PWM) signals. As discussed above, the first current control signal 155 may correspond to the light output by the first light channel 22 while the second current control signal 160 may correspond to the light output by the second light channel 24. In the illustrated embodiment of FIG. 4, the first light channel 22 receives one-third of the DC current output by the variable constant current drive 12 per time period (e.g., 0-t1, t1-t2, etc.), while the second light channel 24 receives two-thirds of the DC current output by the variable constant current drive 12 per time period. In some embodiments, the time periods (e.g., 0-t1, t1-t2, etc.) is within a range of approximately 2.0 milliseconds (msec) to 3.0 msec (e.g., approximately 2.5 msec).

In some embodiments, the switching of DC current provided to the first light channel 22 and the second light channel 24 occurs at a frequency greater than approximately 120 Hz. In other embodiments, the switching of DC current provided to the first light channel 22 and the second light channel 24 occurs at a frequency greater than approximately 240 Hz. In such embodiments, the switching of DC current occurs at a frequency that avoids the perception of flickering to a user. Additionally, as discussed above, as the percentage light control value changes, the first current control signal 155 and the second current control signal 160 change according to the corresponding ratio of current determined by the ratio controller 20.

Figure 5:
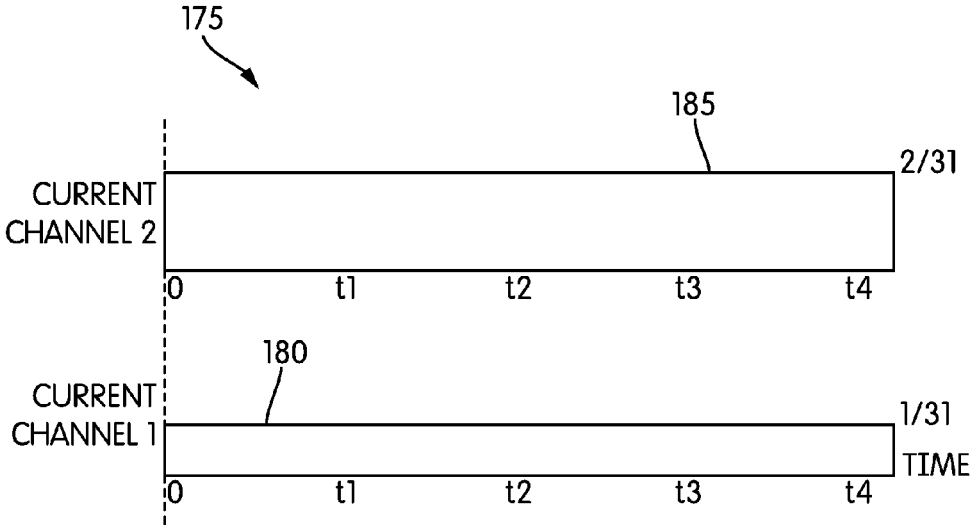
FIG. 5 is a graph illustrating a first current control signal and a second current control signal used in conjunction with the dim-to-warm system of FIG. 1, according to another embodiment of the application.

FIG. 5 is a graph 175 illustrating a first current control signal 180 being supplied to the first current control 26 and a second current control signal 185 being supplied to the second current control 28, according to another embodiment of the application. As discussed above, the first current control signal 180 may correspond to the light output by the first light channel 22 while the second current control signal 185 may correspond to the light output by the second light channel 24. In the illustrated embodiment of FIG. 5, the first current control signal 180 controls the first current control 26 to provide one-third of the DC current output by the variable constant current drive 12 to the first light channel 22, while the second current control signal 185 controls the second current control 28 to provide two-thirds of the DC current output by the variable constant current drive 12 to the second light channel 24. In the illustrated embodiments, as the percentage light control value changes, the first current control signal 180 and the second current control signal 185 change according to the corresponding ratio of current determined by the ratio controller 20.

Figure 6:
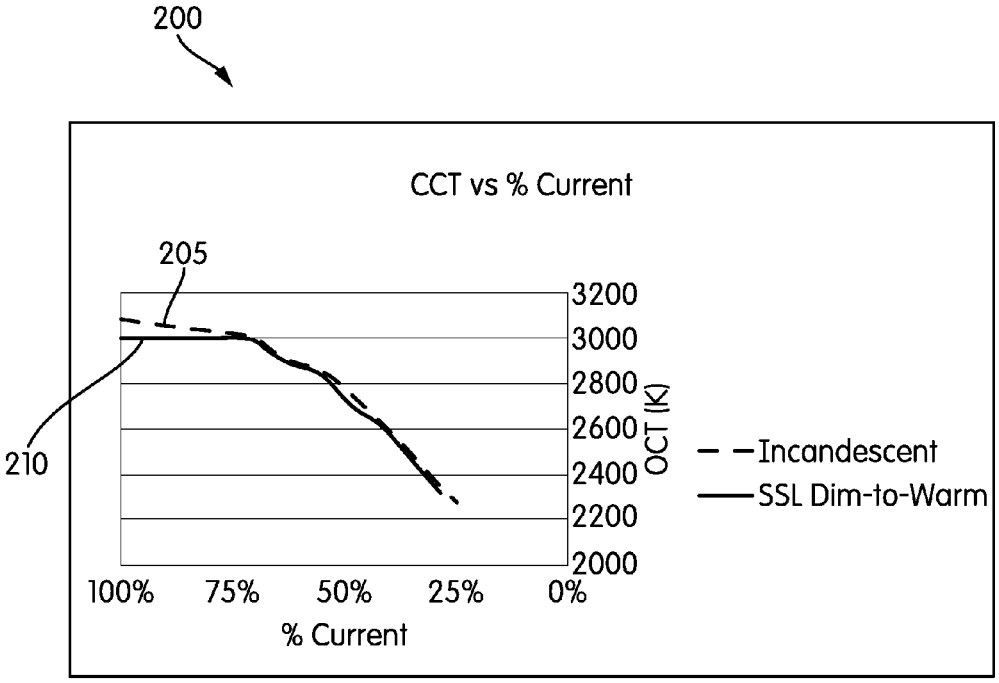
FIG. 6 is a graph illustrating correlated color temperatures (CCTs) versus percentage light control values according to some embodiments of the application

FIG. 6 is a graph 200 illustrating correlated color temperatures (CCTs) versus percentage light control values according to some embodiments of the application. The graph 200 includes a first line 205 and a second line 210. In the illustrated embodiment, the first line 205 corresponds to an incandescent light bulb while the second line corresponds to the dim-to-warm system 10 according to some embodiments of the present application. As illustrated, in some embodiments, the ratio controller 20 controls the portion of current output to the first light channel 22 and the second light channel 24 such that the average CCT of the dim-to-warm system 10 substantially corresponds to the average CCT of an incandescent light bulb.

In some embodiments, the dimming curve adjustment interface 30 may be used to change the correlated color temperature (CCT) of the dim-to-warm system 10. In such an embodiment, the CCT may be changes to accommodate a different desired lighting effect. Additionally, in some embodiments, the dimming curve adjustment interface 30 may be configured to provide information to the ratio controller 20 concerning current output parameters of a replacement current drive having different properties. In such an embodiment, the ratio controller 20 would not replacing when a replacement current drive is used with the dim-to-warm system 10.

Thus, the invention provides, among other things, a system and method of controlling a correlated color temperature for light output by a light system having one or more light-emitting diodes (LEDs). Various features and advantages of the invention are set forth in the following claims.

What is claimed is:

1. A method of controlling a correlated color temperature for light output by a lighting device including a dim-to-warm circuit having a first light channel including a white light emitting diode and a second light channel, the method comprising:

receiving a current input;

measuring current of the current input to obtain a measured current value;

determining a light control value based on the measured current value;

using the light control value, determining a first current value for applying a first current to the white light emitting diode of the first light channel and determining a second current value for applying a second current to the second light channel; and providing the first current to the first light channel and providing the second current to the second light channel to obtain different desired correlated color temperatures for the light output at different ones of the light control value; and adjusting a correlated color temperature curve via a dimming curve adjustment interface.

2. The method according to claim 1, further comprising manually operating a dimming adjustment device to vary a magnitude of the current input.

3. The method according to claim 2, wherein the current input comprises a direct current.

4. The method according to claim 1, wherein the first light channel comprises a plurality of white light emitting diodes and the second light channel comprises a second plurality of light emitting diodes.

5. The method according to claim 4, wherein the second plurality of light emitting diodes include amber light emitting diodes having a different correlated color temperature than the white light emitting diodes.

6. The method according to claim 1, wherein the step of determining of the light control value corresponding to the measured current value comprises comparing the measured current value to a maximum current value in order to determine the light control value as a percentage light control value having a range of approximately 0% to approximately 100%.

7. The method according to claim 6, wherein the current input is provided to the first light channel and the second light channel, and the step of controlling of the first current provided to the first light channel and the second current provided to the second light channel includes providing current to only the first light channel when the percentage light control value is at least approximately 75%.

8. The method according to claim 6, wherein when the percentage light control value is approximately 37%, the current applied to the first light channel is about the same as the current applied to the second light channel.

9. The method according to claim 1, wherein the dimming curve adjustment interface comprises a Bluetooth wireless device.

10. A dim-to-warm lighting system comprising:

a current drive providing a current output;

a current measuring device receiving and measuring the current output from the current drive, the current measuring device further outputting a measured current value of the current output;

a first light channel including a white light emitting diode having a first correlated color temperature and in electrical communication with the current drive;

a first current control controlling a first current through the white light emitting diode of the first light channel based on a first current value;

a second light channel having a second correlated color temperature different than the first correlated color temperature and in electrical communication with the current drive;

a second current control controlling a second current through the second light channel based on a second current value; a dimming curve adjustment interface outputting a corrected color temperature signal; and a controller receiving the measured current value from the current measuring device, the controller configured to:

determine a light control value from the measured current value, using the light control value, determine a first current value for the first current control, using the light control value, determine a second current value for the second current control, communicate the first current value to the first current control, communicate the second current value to the second current control, and provide the light output having a correlated color temperature by providing the first current value to the first current control and the second current value to the second current control, and adjusting the corrected color temperature based on the correlated color temperature signal.

11. The dim-to-warm lighting system according to claim 10, wherein the first light channel and the second light channel provide the light output in response to the first current control providing the first current to the first light channel and the second current control providing the second current to the second light channel.

12. The dim-to-warm lighting system according to claim 10, further comprising a dimming adjustment device to manually vary a magnitude of the current output.

13. The dim-to-warm lighting system according to claim 10, wherein the first light channel comprises a plurality of white light emitting diodes and the second light channel comprises a second plurality of light emitting diodes.

14. The dim-to-warm lighting system according to claim 13, wherein the second plurality of light emitting diodes includes amber light emitting diodes.

15. The dim-to-warm lighting system according to claim 10, wherein the controller determines the light control value by comparing the measured current value to a maximum current value in order to calculate a percentage light control value within a range from approximately 0% to approximately 100%.

16. The dim-to-warm lighting system according to claim 15, wherein the first current control provides the first current to the first light channel and the second current provides approximately no current to the second light channel when the percentage light control value is at least about 75%.

17. The dim-to-warm lighting system according to claim 15, wherein the controller provides the first current value to the first current control and the second current value to the second current control so that approximately the same current is applied to the first light channel and the second light channel when the percentage light control value is approximately 37%.

18. The dim-to-warm lighting system according to claim 10, wherein the dimming curve adjustment interface comprises a Bluetooth wireless device.

* * * * *